US008614702B2

(12) United States Patent
Okamura

(10) Patent No.: US 8,614,702 B2
(45) Date of Patent: Dec. 24, 2013

(54) DISPLAY CONTROL/DRIVE DEVICE AND DISPLAY SYSTEM

(75) Inventor: Kazuhiro Okamura, Tokyo (JP)

(73) Assignee: Renesas Electronics Corporation, Kawasaki-shi (JP)

( * ) Notice: Subject to any disclaimer, the term of this patent is extended or adjusted under 35 U.S.C. 154(b) by 734 days.

(21) Appl. No.: 12/762,211

(22) Filed: Apr. 16, 2010

(65) Prior Publication Data

US 2010/0194737 A1 Aug. 5, 2010

Related U.S. Application Data

(63) Continuation of application No. 11/495,736, filed on Jul. 31, 2006, now Pat. No. 7,728,832.

(30) Foreign Application Priority Data

Sep. 26, 2005 (JP) ..... 2005-277311

(51) Int. Cl.
*G09G 5/00* (2006.01)

(52) U.S. Cl.
USPC ..... 345/213; 345/204; 345/690; 345/691

(58) Field of Classification Search
USPC ..... 345/213, 204, 690–691
See application file for complete search history.

(56) References Cited

U.S. PATENT DOCUMENTS

| | | | | |
|---|---|---|---|---|
| 6,611,000 | B2 * | 8/2003 | Tamura et al. | 257/80 |
| 6,784,868 | B2 * | 8/2004 | Murahashi et al. | 345/103 |
| 7,161,569 | B2 * | 1/2007 | Sekiguchi | 345/87 |
| 7,187,393 | B1 | 3/2007 | Tokimoto et al. | |
| 7,432,903 | B2 * | 10/2008 | Kato | 345/98 |
| 7,508,371 | B2 | 3/2009 | Kitani et al. | |
| 7,956,840 | B2 | 6/2011 | Ishii | |
| 2004/0233226 | A1 * | 11/2004 | Toriumi et al. | 345/690 |

FOREIGN PATENT DOCUMENTS

| | | | |
|---|---|---|---|
| JP | 2003-233358 A | | 8/2003 |
| JP | 2004-029540 A | | 1/2004 |
| JP | 2005-092176 | | 4/2005 |
| JP | 2005-115092 | * | 4/2005 |
| JP | 2007-017564 | | 1/2007 |
| JP | 2007-025632 | | 2/2007 |

OTHER PUBLICATIONS

Japanese Office Action received in Japanese App. No. 2005-277311 (and English translation).

Office Action (and English translation) issued Dec. 7, 2012, in Korean App. No. 10-2006-92905.

Japanese Office Action received in Japanese App. No. 2005-277311 (and English translation), Dec. 7, 2005.

* cited by examiner

*Primary Examiner* — William Boddie
*Assistant Examiner* — Leonid Shapiro
(74) *Attorney, Agent, or Firm* — Miles & Stockbridge P.C.

(57) ABSTRACT

A display control/drive device (a liquid crystal controller driver and a semiconductor integrated circuit for driving liquid crystals) which can serve to reduce peak currents and thereby restrain the occurrence of EMI is to be provided. In a liquid crystal display control/drive device in which image signals to be applied to signal lines of a color liquid crystal panel are generated in response to display image data that are received, image signals for pixels of the same color are divided into a plurality of groups. And during a period in which the substantial frame frequency can be reduced, the period of a line clock matching one horizontal period is extended to slightly stagger the output timing of image signals from one to another of the groups and the sequence of outputs from the different groups is periodically varied.

7 Claims, 8 Drawing Sheets

DISPLAY CONTROL/DRIVE DEVICE AND DISPLAY SYSTEM

CROSS-REFERENCE TO RELATED APPLICATION

This application is a continuation of application Ser. No. 11/495,736 filed Jul. 31, 2006 now U.S. Pat. No. 7,728,832. The present application also claims priority from Japanese patent application No. 2005-277311 filed on Sep. 26, 2005 the content of which is hereby incorporated by reference into this application.

BACKGROUND OF THE INVENTION

The present invention relates to a display control/drive device for driving a display panel, and more particularly to a technique that can be effectively applied to the drive signal output system for display control/drive devices configured as semiconductor integrated circuits, for instance a technique that can be effectively applied to a liquid crystal display control/drive device for driving a low temperature poly-silicon (LTPS) liquid crystal panel and a liquid crystal display system using the device.

In recent years, a dot matrix type liquid crystal panel in which a plurality of display pixels are two-dimensionally arrayed in a matrix form has come to be used as the display device for mobile electronic apparatuses, such as mobile telephones and personal digital assistants (PDAs), and within each such apparatus, a display control/drive device (liquid crystal controller), configured as a semiconductor integrated circuit, for controlling this liquid crystal panel, a liquid crystal driver for driving the liquid crystal panel, or a display control/drive device (liquid crystal controller/driver) with a built-in driver, is mounted.

A liquid crystal driver supplies drive signals for the liquid crystal panel in synchronism with entered line output signals to provide the timings for application to source lines. In a conventional liquid crystal driver, since drive signals are supplied at the same timing from all the output terminals, currents to drive the liquid crystal panel concentrate, giving rise to a momentary flow of a large current, which invites spike-shaped noise on the power supply line and signal lines or a drop in power voltage.

Generally, an electronic device increasingly requires, as its electromagnetic environment becomes more complex, consideration of electromagnetic interference (EMI) not only in itself but also in the system in which it is a constituent part. In the aforementioned liquid crystal display device using the conventional liquid crystal driver, a large current momentarily flows because the source line of the liquid crystal panel is driven at the same time, and the resultant generation of spike-shaped noise on the power supply line and signal lines may invite EMI. In order to reduce this EMI as well, the concentration of currents to drive the liquid crystal panel should be prevented. To meet this requirement, there is proposed an invention regarding a source driver in which a plurality of source outputs are divided into two groups, such as a right half group and a left half group, and the output timings are staggered to avoid concentration of currents and thereby to restrain the occurrence of EMI (Patent Document 1).

On the other hand, liquid crystal panels available today include what is called an LTPS liquid crystal panel, which uses low temperature poly-silicon. Since a liquid crystal panel uses a glass substrate, its manufacturing process can involve no high temperature step. An LTPS liquid crystal panel uses poly-silicon into which amorphous silicon is transformed by poly-crystallization by laser annealing or otherwise, and has an advantage of permitting faster operation of transistors than amorphous silicon.

Incidentally, a color liquid crystal panel is provided with pixels of three primary colors including red (R), green (G) and blue (B), and each pixel is provided with a pixel electrode and a switching element consisting of a thin film transistor (TFT) for charging and discharging the pixel electrode. The sources of the switching elements of pixels of the same row are connected to common wiring for communicating image signals (called a source line or a data line).

In the conventional color liquid crystal panel, since each source line is provided with an external terminal, the number of external terminals increases with an increase in panel size, namely the number of display dots. As the liquid crystal panel is large relative to the display control/drive device, configured as a semiconductor integrated circuit, for driving this panel, the increase in the number of external terminals with an increase in panel size poses no serious problem. However, as the chip area and the package volume in a display control/drive device configured as a semiconductor integrated circuit increase with an increase in the number of external terminals, there is a demand for minimizing the number of external terminals.

An LTPS liquid crystal panel, since transistors can operate at high speed, can be so configured that a selector consisting of a transistor is provided on the liquid crystal panel side to have signals of pixels of three colors entered from a common external terminal on a time sharing basis. Inventions regarding a liquid crystal controller driver in which pixels of three colors are entered from a common external terminal on a time sharing basis include, for instance, what is disclosed in Patent Document 2.

[Patent Document 1] Japanese Patent Application Laid-Open No. 2003-233358

[Patent Document 2] Japanese Patent Application Laid-Open No. 2004-029540

SUMMARY OF THE INVENTION

According to the invention disclosed in Patent Document 1 cited above, when the grouped source lines are to be driven, though the timings are staggered by, for instance, driving the source lines of the left half after driving the source lines of the right half, the sequence of driving the divided source lines remains fixed. As a result, though this is effective against EMI to some extent, the fixed sequence of driving the grouped source lines causes the voltages applied to the source lines to be applied to pixel electrodes via thin film transistors (TFTs) turned on and off by signals on gate lines, a fall in the voltages on the gate lines makes it impossible for voltages on the source lines to be applied to the pixel electrodes. As a result, there occurs a difference in effective voltage, though only a slight one, between the right and left source lines, which might invite a deterioration of the quality of images displayed on the liquid crystal panel.

On the other hand, in the driver for LTPS liquid crystal panels disclosed in Patent Document 2 cited above, drive signals for pixels of the same color on the same line are varied at the same timing. This entails a problem that the occurrence of EMI due to peak currents is not sufficiently restrained. It is therefore conceivable to apply the invention disclosed in Patent Document 1 to the drivers for LTPS liquid crystal panels, divide drive signals for pixels of the same color on the same line into a plurality of groups, and perform driving at staggered timings.

However, if in the driver for LTPS liquid crystal panels signals of pixels of three colors are to be entered from a common external terminal on a time sharing basis, entering signals of different signals in each of three sections into which one horizontal period is divided would reduce the time allocated for charging each pixel electrode by one third. Moreover, if drive signals for pixels of the same color are divided into a plurality of groups and the timings of driving are staggered, the time allocated for charging each pixel electrode will be further reduced. As a consequence, there is a need to increase the driving force of the driver or the amplifier on the liquid crystal display control/drive device side, entailing a problem that peak currents cannot be effectively reduced.

An object of the present invention is to provide a display control/drive device (a liquid crystal controller driver and a semiconductor integrated circuit for driving liquid crystals) which can reduce peak currents and thereby restrain the occurrence of EMI.

Another object of the invention is to provide a display control/drive device which can suppress peak currents, reduce the power supply capacity requirement and thereby save the cost.

Still another object of the invention is to provide a display control/drive device which can drive displaying of high picture quality while reducing peak currents and thereby restraining the occurrence of EMI.

These and other objects and novel features of the invention will become apparent from the description in this specification when taken in conjunction with the accompanying drawings.

A typical one of the aspects of the invention disclosed in this application will be briefly summarized below.

In a liquid crystal display control/drive device in which image signals to be applied to the signal lines of a color liquid crystal panel are generated in response to display image data that are received, and drive signals for pixels of the same color on each line are collectively supplied, image signals for pixels of the same color are divided into a plurality of groups. And in a period in which the substantial frame frequency can be reduced, the horizontal period is extended to slightly stagger the output timing of image signals from one to another of the groups and the sequence of outputs from the different groups is periodically varied.

As the output timings of image signals slightly stagger from one group to another in the above-described configuration, concentration of currents and their flow to the display panel can be prevented, thereby making possible a reduction in EMI. Also, as the period of the line clock corresponding to one horizontal period is extended to slightly stagger the output timings of image signals from one to another of the groups, the time allocated for charging each pixel electrode is not reduced, making it unnecessary to increase the driving force of the driver or the amplifier for the liquid crystal display control/drive device and enabling the peak current to be reduced. As a result the occurrence of EMI can be suppressed, the power supply capacity requirement can be reduced and the cost can be thereby saved.

Furthermore, as the sequence of outputs from the different groups is periodically varied, the durations of image signal application to the pixel electrodes are uniformized thereby to uniformize the effective voltages, making it possible to avoid a deterioration in image quality. This makes possible realization of a display control/drive device (liquid crystal controller driver) whose image quality does not deteriorate even where a plurality of signal lines (source lines) are divided into a plurality of groups, and the lines are driven with time lags between the groups to suppress EMI.

As the period in which the substantial frame frequency can be reduced here, there is, for instance, a partial display mode setting period in a liquid crystal display control/drive device during which control to save power consumption is possible by using only a partial area of the display screen for displaying (hereinafter referred to as partial displaying).

Or it is desirable to provide a switching circuit to periodically vary the output sequence of the grouped image signals, to generate the control signal for the switching circuit on the basis of an alternating signal for giving a period for A.C.-driving the pixels of the liquid crystal panel, and to vary the output sequence from the output amplifiers of the different groups according to the period of the alternating signal. The alternating signal is a signal indispensable for the liquid crystal driver. Therefore, by generating the control signal for the switching circuit on the basis of the alternating signal, there can be realized a liquid crystal display control/drive device in which the concentration of currents flowing through the liquid crystal panel can be avoided to suppress the occurrence of EMI without having to increase the number of input signals or that of terminals or to alter the system configuration substantially, moreover display driving for high quality images being made possible.

Furthermore, image signals on the same line and of the same color are divided into a plurality of groups, the output timings of image signals are slightly staggered from group to group, the output sequence of the groups is periodically varied, and there is further provided a register which sets this function of output control with time lags to be valid or invalid.

In some systems using a liquid crystal panel, the period of the line output timing may be too short to provide a long enough time for pixel electrode charging, and validating the function of output control with time lags for such a liquid crystal panel may invite a deterioration in displayed image quality. The above-described configuration can provide a convenient liquid crystal display control/drive device which can either turn or turn off that function of output control with time lags according to the characteristics of the liquid crystal panel to be used. As a method to divide the output amplifiers into a plurality of groups, dividing them into two right and left groups is desirable, but grouping of odd-number and even-number output amplifiers would also be acceptable.

The advantages provided by typical aspects of the present invention disclosed herein are briefly summarized below.

According to the invention, a display control/drive device (a liquid crystal controller driver and a semiconductor integrated circuit for driving liquid crystals) which can drive displaying of high picture quality while reducing peak currents and thereby restraining the occurrence of EMI can be realized.

DESCRIPTION OF THE PREFERRED EMBODIMENT

A preferred embodiment of the present invention will be described in detail with reference to the accompanying drawings.

Figure 1:
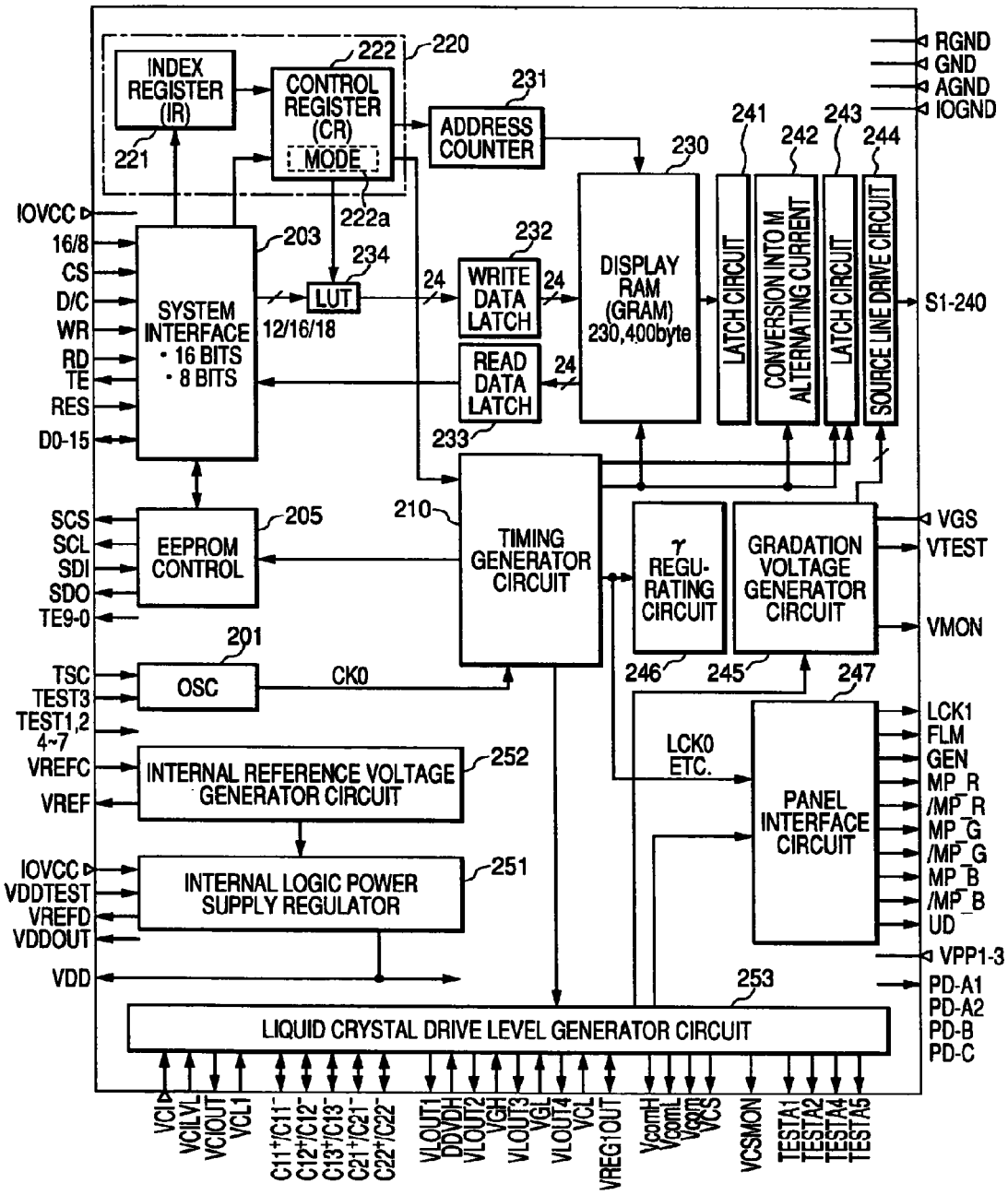
FIG. 1 is a block diagram showing a schematic configuration of a liquid crystal controller driver to which the present invention is applied.

FIG. 1 shows a liquid crystal controller driver 200, which is a preferred embodiment of the invention. The circuit blocks shown in FIG. 1 are configured as semiconductor integrated circuits over a single semiconductor chip of monocrystalline silicon or the like, fabricated by known semiconductor manufacturing technology, though its configuration is not particularly limited to this.

This liquid crystal controller driver 200 embodying the invention is provided with an oscillator circuit 201 for generating a reference clock signal CK0 for inside the chip on the basis of an oscillation signal from outside or an oscillation signal from an oscillator connected to an external terminal, and a timing control circuit 210 for generating various timing control signals and a plurality of clock signals differing in cycle and phase for inside the chip on the basis of the generated reference clock signal CK0.

The liquid crystal controller driver 200 is also provided with a control unit 220 for controlling the whole inside of the chip in accordance with an instruction from an external microprocessor or microcomputer, and a system interface 203 for transmitting and receiving data including data to be set in a register and image data to and from the microcomputer via a system bus. The liquid crystal controller driver 200 is further equipped with an EEPROM control circuit 205 for generating a control signal SCS, a clock signal SL and so forth for serially writing or reading data into or out of an external nonvolatile memory (EEPROM).

Also, this liquid crystal controller driver 200 embodying the invention is provided with a display random access memory (RAM) 230 as a display memory for storing display data by a big map formula, and an address counter 231 generating addresses for the display RAM 230. It is further equipped with a write data latch circuit 232 for holding write data to be written into the display RAM 230 and a read data latch circuit 233 for holding read data readout of the display RAM 230. Between the write data latch circuit 232 and the system interface 203, there is disposed a buffering data latch circuit 234 for temporarily holding 12-bit, 16-bit or 18-bit write data entered into the system interface 203 and handing them over to the display RAM 230 as data suitable for the read/write unit of the display RAM 230, such as 2-bit data.

The control unit 220 is provided with a control register 222 for controlling the operating state of the whole chip including the operating mode of this liquid crystal controller driver 200 and an index register 221 for storing index information for referencing the control register 222. The control register 222 includes a mode register 222*a* shown in FIG. 4. The control method is such that, when the instruction to be executed is designated by writing by the external microcomputer into the index register 221, the control unit 220 generates a control signal matching the designated instruction. The method of control by the control unit 220 may as well be such that, upon receipt of a command code from the external microcomputer, this command is decoded to generate a control signal.

Under control by the control unit 220 configured in this way, the liquid crystal controller driver 200, when performing display on a liquid crystal panel in accordance with an instruction and data from the microcomputer, carries out graphics image processing by which display data are successively written into the display RAM 230. Along with this, display data are periodically read out of the display RAM 230 to generate and supply voltage signals (image signals and source line drive signals) to be applied to the source line of the liquid crystal panel. Downstream from the display RAM 230, there are disposed a first latch circuit 241 which latches image data read out for displaying, an M alternating circuit 242 for conversion into A.C. data to prevent liquid crystals from deterioration, a second latch circuit 243, and a source line drive circuit 244 for generating and supplying voltage signals to be applied to the source line of the liquid crystal panel correspondingly to the image data.

Further, this liquid crystal controller driver 200 embodying the invention is provided with a gradation voltage generator circuit 245 for generating gradation voltages needed for generating waveform signals suitable for color displaying and gradation displaying, a γ regulating circuit 246 for setting a gradation voltage matched with the γ characteristic of the liquid crystal panel, a panel interface circuit 247 for generating control signals and clock signals needed for control the operation of an external liquid crystal panel and so forth. The source line drive circuit 244 selects a voltage matching display image data out of the plurality of gradation voltages supplied from the gradation voltage generator circuit 245 and outputs voltage signals S1 through S240 to be applied to the source line of the liquid crystal panel.

Incidentally, this liquid crystal controller driver 200 embodying the invention is so configured as to supply, according to the configuration of the liquid crystal panel, R, G and B drive signals of the pixels from the source line drive circuit 244 through a common terminal. Along with this, RGB designating signals MP_R, MP_G and MP_B indicating the color of the pixel drive signal supplied to the liquid crystal panel or the duration of their supply, their inverted signals /MPR, /MPG and /MPB, a clock LCK corresponding to the period of one line and so forth are generated and supplied by the panel interface circuit 247.

The liquid crystal controller driver 200 is also equipped with a voltage regulator 251 for generating, on the basis of an externally supplied voltage 10Vcc which may be 3.3 V or 2.5 V for instance, an internal power voltage Vdd required for the operation of internal circuits, a reference voltage generating circuit 252 for generating a reference voltage required by the regulator, and a liquid crystal drive level generator circuit 253 for generating voltages required by the gradation voltage generator circuit 245 and the panel interface circuit 247.

Figure 2:
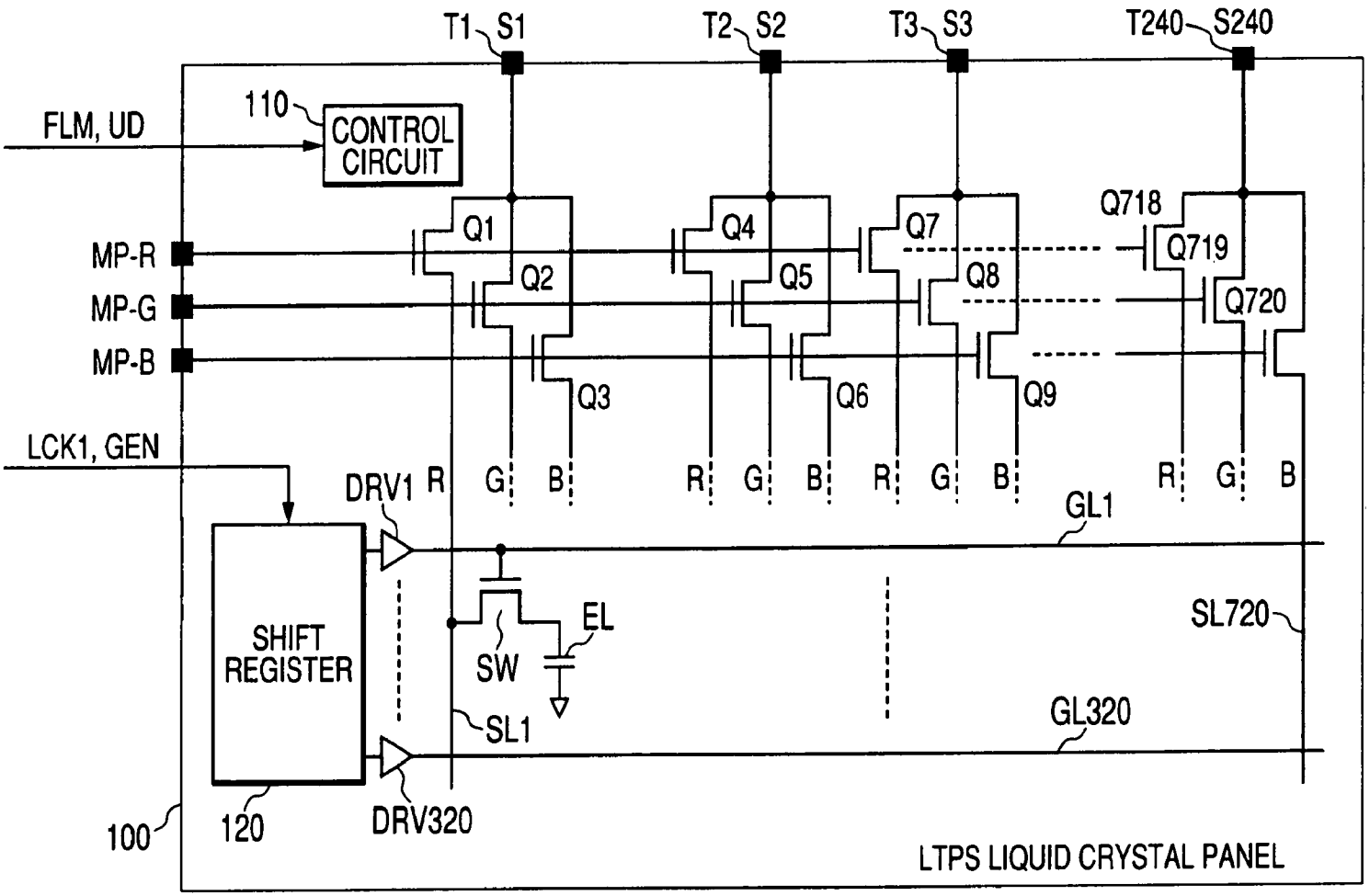
FIG. 2 shows an example of system configuration of an LTPS liquid crystal panel driven by the liquid crystal controller driver to which the invention is applied.

The driven by this liquid crystal controller driver 200 embodying the invention is a color low temperature polysilicon (LTS) TFT liquid crystal panel of a dot matrix type, in which display pixels are arrayed in a matrix form and each pixel is composed of three dots or red, blue and green. FIG. 2 shows a schematic configuration of the LTPS liquid crystal panel.

In a liquid crystal panel 100 in this embodiment, red (R), green (G) and blue (B) pixels are arranged in a repeating sequence on each line, and pixels of the same color are arranged on each row, though the arrangement is not particularly limited to this. Each pixel is configured of a switching element S consisting of a TFT and a pixel electrode EL, and electric charges corresponding to image signals are accumulated for pixel capacitances between pixel electrodes and opposed common electrodes with liquid crystals in-between.

Referring to FIG. 2, GL1 through GL320 are gate lines to which the gates of the switching elements of the pixels on the same line are connected in common. Each gate line is set to the selection level once every frame period, and the switching elements connected to the gate line of the selection level is turned on, and all others are kept off. SL1 through SL720 are source lines to which the sources of the switching elements of the pixels on the same row are connected in common. Image signals are communicated to the pixels via these source lines, and the pixel electrodes are electrically charged according to the image signals.

The liquid crystal panel 100 in this embodiment is provided with segment terminals T1 through T240, ⅓ of the source lines SL1 through SL720 in number, and one out of groups of three source lines SL1 through SL3, SL4 through SL6, SL718 through SL720, each group matching the pixel rows of RGB, can be connected to the segment terminals T1 through T240 via RGB selection switching elements Q1 through Q3, Q4 through Q6, . . . , Q718 through Q720, three each of which constitute one set.

The RGB selection switching elements Q1 through Q3, Q4 through Q6, . . . , Q718 through Q720 undergo successive on/off controls with the RGB designating signals MP_R, MP_G and MP_B and their inverted signals /MP_R, /MP_G and /MP_B supplied from the panel interface circuit 247 of the liquid crystal controller driver 200. The RGB designating signals are made differential signals because transmission gates in which P-channel MOSFETs and N-channel MOSFETs are coupled in parallel are used as the selection switching element Q1 through Q3, Q4 through Q6, . . . , Q718 through Q720. In FIG. 2, MOSFETs on one side and signals on one side alone are shown on account of the limitation of available space.

In this liquid crystal panel 100 of the embodiment, gate drivers DRV1 through DRV320 respectively matching and driving the gate lines GL1 through GL320 are provided, and also a shift register 120 is disposed in a direction orthogonal to the gate lines GL1 through GL320. The liquid crystal panel 100 is further equipped with a control circuit 110 for generating control signals for use within the panel on the basis of a signal FLM indicating one frame period, supplied from the liquid crystal controller driver 200, a control signal UD indicating the shifting direction of a shift register SFR and so forth.

The outputs of the flip-flops of different stages constituting the shift register 120 are supplied to the input terminals of the gate drivers DRV1 through DRV320. When an enable signal GEN supplied from the liquid crystal controller driver 200 is raised to a significant level, the shift register 120 causes "1" to complete one round in one frame period with the line clock LCK1. This causes each of the gate lines to take on the selection level once every frame period.

Figure 3:
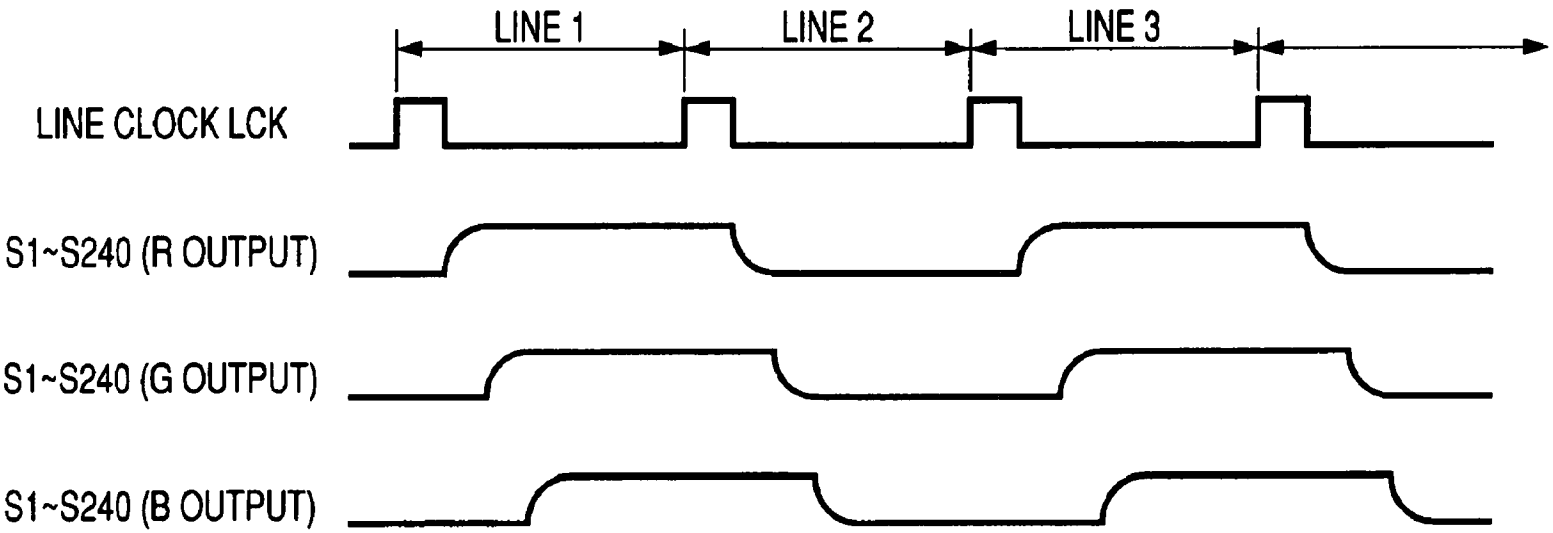
FIG. 3 is a timing chart showing the output timings of source line drive signals in a normal mode, supplied from the liquid crystal controller driver to which the invention is applied.

Further, RGB designating signals MP_R, MP_G and MP_B are altered to a high level in sequence during one horizontal period in which one gate line is at the selection level. Then, image signals supplied from the liquid crystal controller driver 200 are communicated by the switching elements Q1 through Q720 to one out of the set of three source lines. From the liquid crystal controller driver 200, image signals S1 through S240 of RGB are also supplied within one horizontal period in synchronism with the line clock LCK1 on a time sharing basis as shown in FIG. 3. This causes, in the liquid crystal panel, image signals to be applied to the electrodes of pixels connected to selection gate lines in the order of RGB pixels and the pixel capacitances to be charged.

Further in this liquid crystal controller driver 200 embodying the invention, the mode register 222*a* for setting a display mode which allows the substantial frame period to be delayed by extending the cycle of the line clock LCK1 is provided within the control register 222. In this embodiment, as an example of such mode, a partial display which displaying is done in a partial area of the display screen (of the liquid crystal panel) is supposed.

Figure 4:
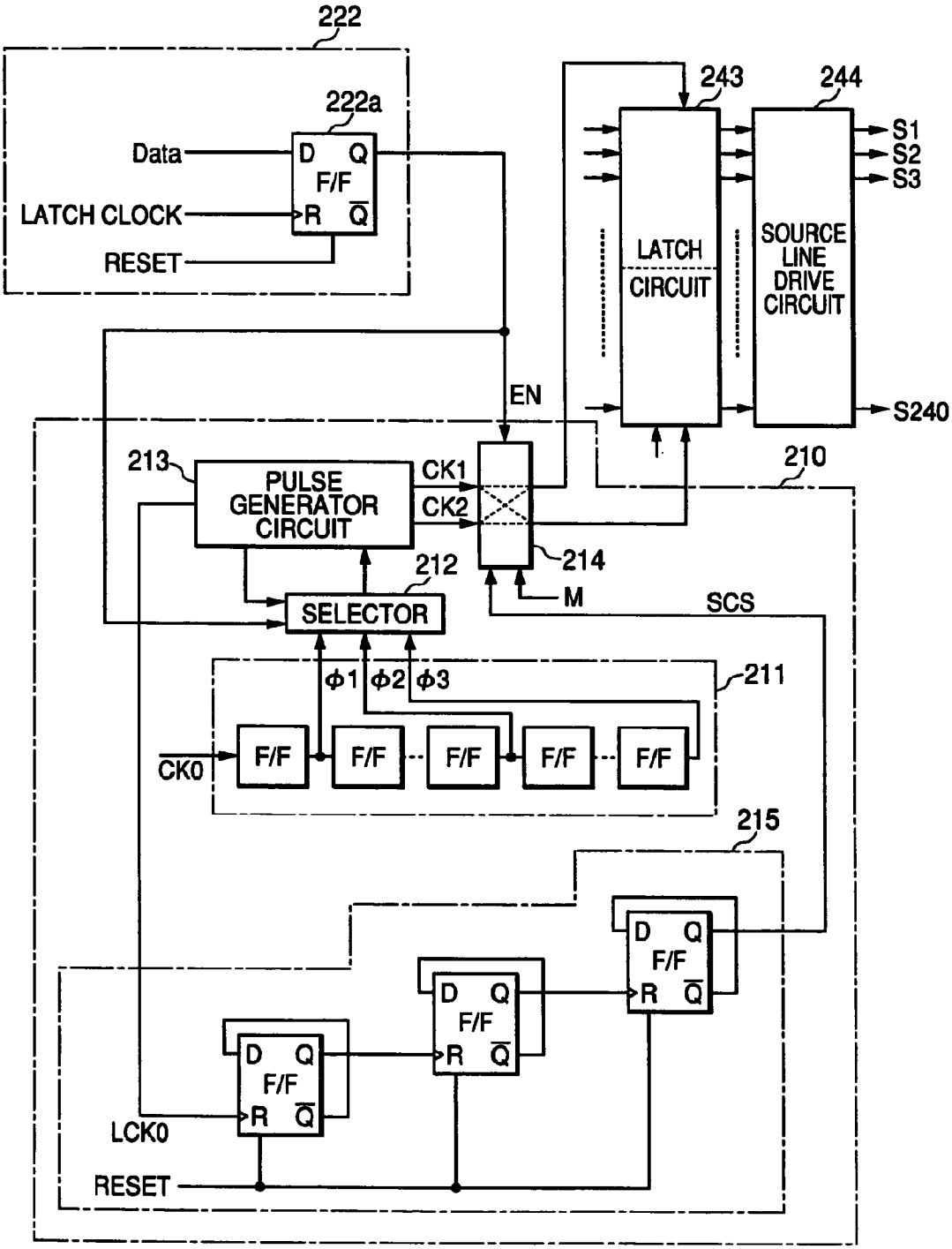
FIG. 4 is a block diagram showing an example of circuit configuration within a timing generator circuit in the liquid crystal controller driver to which the invention is applied.

FIG. 4 shows an example of specific circuit which, when "1" is set in the mode register 222*a*, extends the line clock cycle and varies the output timings of the image signals S1 through S24 supplied from the source line drive circuit 244.

In FIG. 4, reference numeral 211 denotes a frequency dividing circuit for dividing the frequency of the reference clock signal CK0 generated by the oscillator circuit 201; 212, a selector for selecting a clock of a prescribed frequency out of the clocks resulting from the frequency division by the frequency dividing circuit 211; 213, a pulse generator circuit, consisting of a delay circuit or a logic gate circuit, for generating a line clock LCK0 and clocks CK1 and CK2 to give the output timings of the image signals S1 through S240 on the basis of a clock selected by the selector 212; 214, a clock selection switching circuit for appropriately selecting clocks CK1 and CK2 an supplying them to the latch circuit 243 of the prior stage to the source line drive circuit 244; and 215, a frequency dividing circuit for dividing the frequency of the line clock LCK0 to generate the control signal SCS of the clock selection switching circuit 214. These circuits are disposed within the timing generator circuit 210 shown in FIG. 1.

The clock CK2 is slightly behind the clock CK1 in phase. Though not shown in FIG. 4, there are provided a circuit for generating a frame sync signal FLM by further dividing the frequency of a clock resulting from frequency division by the frequency dividing circuit 211 and another circuit for generating timing signals for the display RAM 230, the latch circuit 241, the M alternating circuit 242 and so forth on the basis of clocks taken out by the frequency dividing circuit 211 or the like.

In this embodiment, when a display mode which permits extension of the frame period is set in the mode register 222*a*, the clock selection switching circuit 214 causes the clocks CK1 and CK2 either to go through or to cross in a prescribed period according to the control signal SCS from the frequency dividing circuit 215, with the output of the register serving as an enable signal EN, and supplies them to the latch circuit 243. The prescribed period is determined by the frequency division ratio of the frequency dividing circuit 215. Where the frequency dividing circuit 215 consists of three flip-flops connected in series as in the embodiment of FIG. 4, the prescribed period is a length of time corresponding to four periods of the line clock LCK0.

The latch circuit 243 can hold 240 image data, of which the data output timing of each half is composed to be variable. More specifically, when the mode register 222*a* is set in a normal mode, the enable signal EN is reduced to a low level, and the clock selection switching circuit 214 supplies the clock CK1 in common to the two groups of the latch circuit 243. This causes the latch circuit 243 to supply the 240 image data simultaneously to the source line drive circuit 244, and the 240 output signals of the source line drive circuit 244 simultaneously vary.

On the other hand, when the display mode which permits extension of the frame period is set in the mode register 222*a*, the enable signal EN is raised to a high level, and the clock selection switching circuit 214 causes the clocks CK1 and CK2 either to go through or to cross in the prescribed period, and supplies them to the latch circuit 243. This causes the latch circuit 243 to first supply a half (the left half S1 through 5120) of the 240 image data in synchronism with the clock CK1, and then to supply the remaining half (the right half 5121 through 5240) of the image data in synchronism with the clock CK2. By continuing this for four periods of the line clock LCK0, namely supplying a four-line equivalent of image data (240×3×4), the clocks CK1 and CK2 are caused to cross and supplied to the latch circuit 243.

Then, the latch circuit 243, reversing the output sequence of the right and left image data, first supplies the right half (S121 through S240) of the 240 image data in synchronism with the clock CK1 and then supplies the left half (S1 through 5120) of the image data in synchronism with the clock CK2. After continuing this for four periods of the line clock LCK0, it again reverses the output sequence of the data, and supplies half of them at a time. Then, as drive signals matching the image data supplied from the latch circuit 243 are generated and supplied by the source line drive circuit 244, the output timings of the source line drive signals are also lagged half by half.

Figure 5:
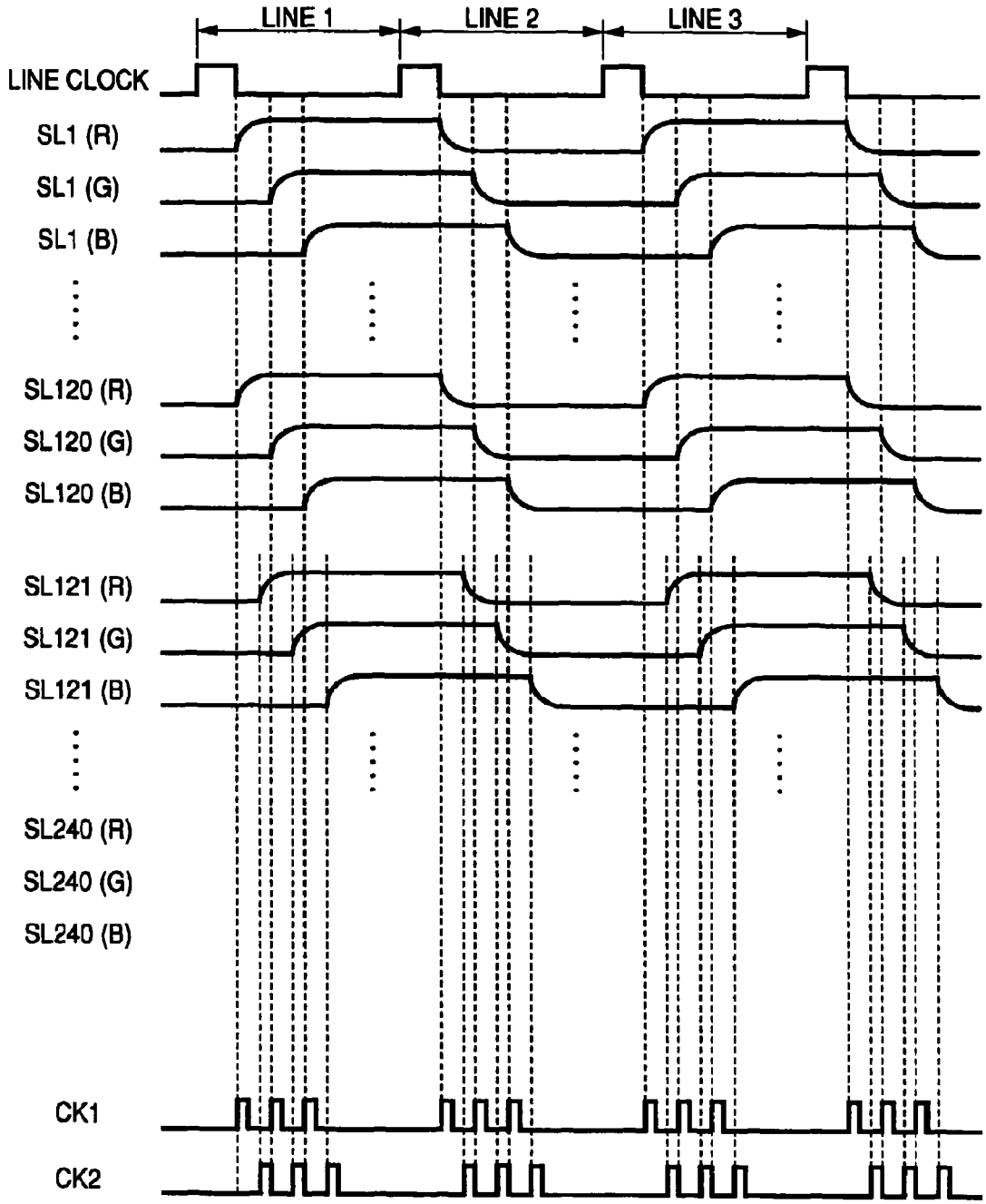
FIG. 5 is a timing chart showing the output timings of the source line drive signals in a mode in which the substantial frame cycle supplied from the liquid crystal controller driver to which the invention is applied is slow.

By starting the output timings of the halves of the image data and control pulses MP_R, MP_G and MP_B for RGB selection switches Q1 through Q720 on the liquid crystal panel side in synchronism with the clocks CK1 and CK2, the rise timings of the source lines SL1 through SL120 can be staggered half by half as shown in FIG. 5. The peak of currents flowing in the whole liquid crystal panel can be thereby suppressed. Or, signals from the frequency dividing circuit 215 the alternating signal M can be combined to control the timing of switching by the clock selection switching circuit 219. This would enable the driving of only a prescribed part in the display area by a delayed source signal to be avoided and a deterioration in image quality due to the staggered timing to be prevented.

Incidentally, the reason why the output timings are staggered only in the mode which permits extension of the frame period is that in the normal mode the horizontal period is too short to secure a sufficient time for charging pixels if the timings of the clocks CK1 and CK2 are staggered beyond a certain extent. The reason will be explained in further detail below. As stated above, the source line drive signals are successively captured into the source lines SL1 through SL720 line by line via the RGB selection switches Q1 through Q720 on the liquid crystal panel side. And the voltages of the source line are applied to the pixel electrodes only during the period in which the signal input terminals T1 through T240 and the source lines S1 through 5720 are connected by the RGB selection switches Q1 through Q720 and the switches of pixels are kept on by the gate drivers DRV1 through DRV320.

Therefore, when the RGB selection switches Q1 through Q720 are turned off, the application of drive signals to the source lines is ended and, when the switches of pixels are turned off, charging of the pixel capacitances is ended. Thus, delaying the output timings of the source line drive signals by half the number, the displayed image quality may be deteriorated by the shortening of the charging period because the switching of the RGB selection switches Q1 through Q720 and the level variation of the gate lines take place at the same time on each line. On the other hand, if the staggering between the clocks CK1 and CK2 in time is reduced to secure a long enough charging period for pixels, the peak current cannot be sufficiently suppressed.

In view of this problem, the output timings are staggered only in the mode which permits extension of the frame period. Yet, since the difference in charging period between the pixels of halves of a line is inevitable, in a long period of tens of frames, the effective voltage may differ between the right and left halves of the screen and invite a deterioration in image quality. However, in this embodiment of the invention, as the output sequence of half of data is reversed in every four periods of the line clock LCK0 in a long period extending over a plurality of frames, the effective voltages applied to pixels are uniformized, and accordingly a deterioration in image quality can be suppressed. Incidentally, the timings of latching by the latch circuit 243 of image data supplied from the alternating circuit 242 at the preceding stage are the same for all the 240 data irrespective of the display mode, and the signal to give that latch timing is generated by the pulse generator circuit 213 in synchronism with a signal indicating one horizontal period (the line clock LCK0).

Figure 6:
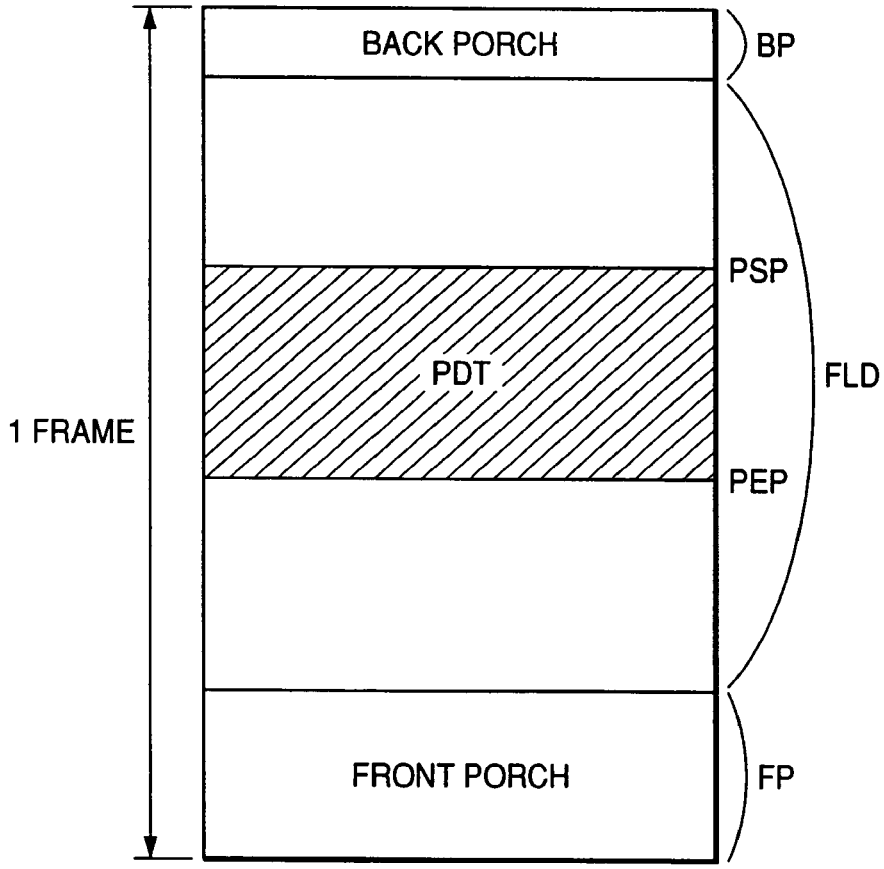
FIG. 6 illustrates the relationship, in a system to which the liquid crystal controller driver embodying the invention is applied between the display screen and the display area when partial displaying is to be done.
Figure 7:
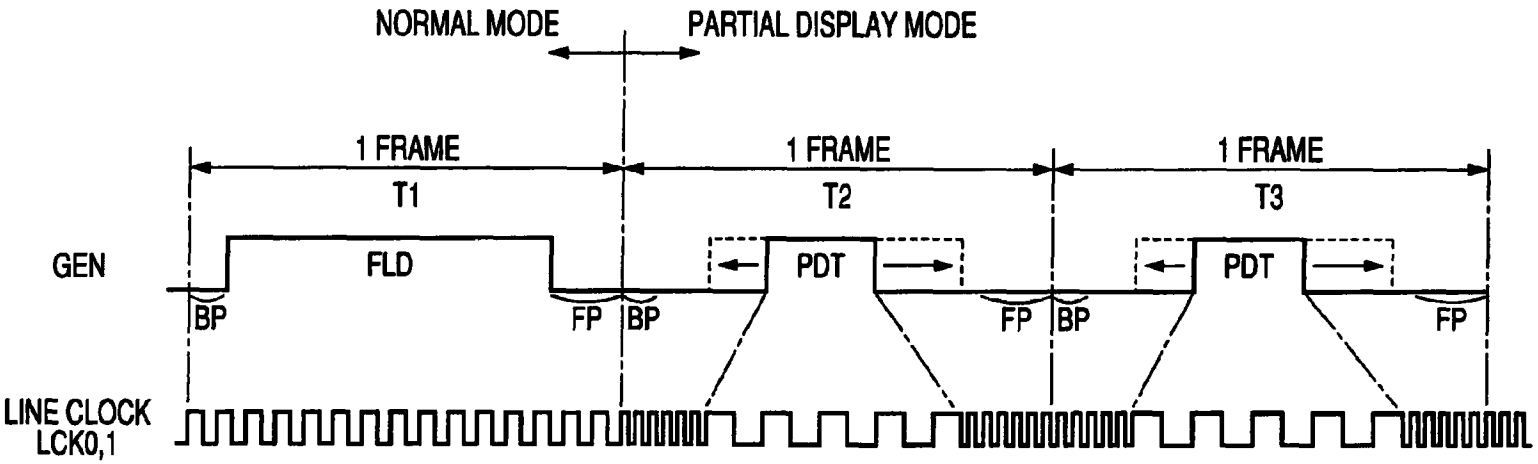
FIG. 7 is a timing chart showing the relationship between the gate enable signal and the line clock in the partial display mode in the liquid crystal driver embodying the invention.

Further in the liquid crystal controller driver embodying the invention, when a partial display mode in which displaying is performed only in a partial area PDT of the display area FLD as shown in FIG. 6 is set in the mode register 222*a* to save power consumption, the frequency of the line clock LCK0 is kept high until the scanning line comes to the partial displaying start position PSP as shown in FIG. 7. In other words, the selector 212 is switched to have the frequency dividing circuit 211 supply a higher frequency clock ϕ1 to the pulse generator circuit 213 to generate the line clock LCK0. Thus, the period of the line clock LCK0 is extended.

And when the scanning line comes to the partial displaying end position PEP, the selector 212 is switched to have the frequency dividing circuit 211 supply again a higher frequency clock ϕ1 to the pulse generator circuit 213 to raise the frequency of the line clock LCK0. Incidentally in the normal mode, the selector 212 selects a clock ϕ 2 of a frequency between ϕ1 and ϕ3, and this clock continues to be supplied to the pulse generator circuit 213, with the line clock LCK0 of the same frequency being generated throughout one frame period as in the period T1 in FIG. 7. This makes one frame period in the partial display mode and one frame period in the normal mode substantially equal in length.

Here, the start position PSP and the end position PEP of partial displaying can be set in advance in a prescribed register. In FIG. 6, BP stands for a back porch and FP, a front porch. The frame period can be varied according to the lengths of the back porch BP, the display area FLD and the front porch FP. In partial displaying, since the period of gate selection by the gate driver on the panel should also be extended, the period of the line clock LCK1 supplied to the shift register 120 is extended similarly to that of the line clock LCK0 in the timing generator circuit 210. In order to set the periods of the line clocks LCK0 and LCK1 for partial displaying, it is made possible to set, for instance, the frequency division ratio of a frequency divider (not shown) for generating the line clock LCK0 within the control register 222.

Figure 8:
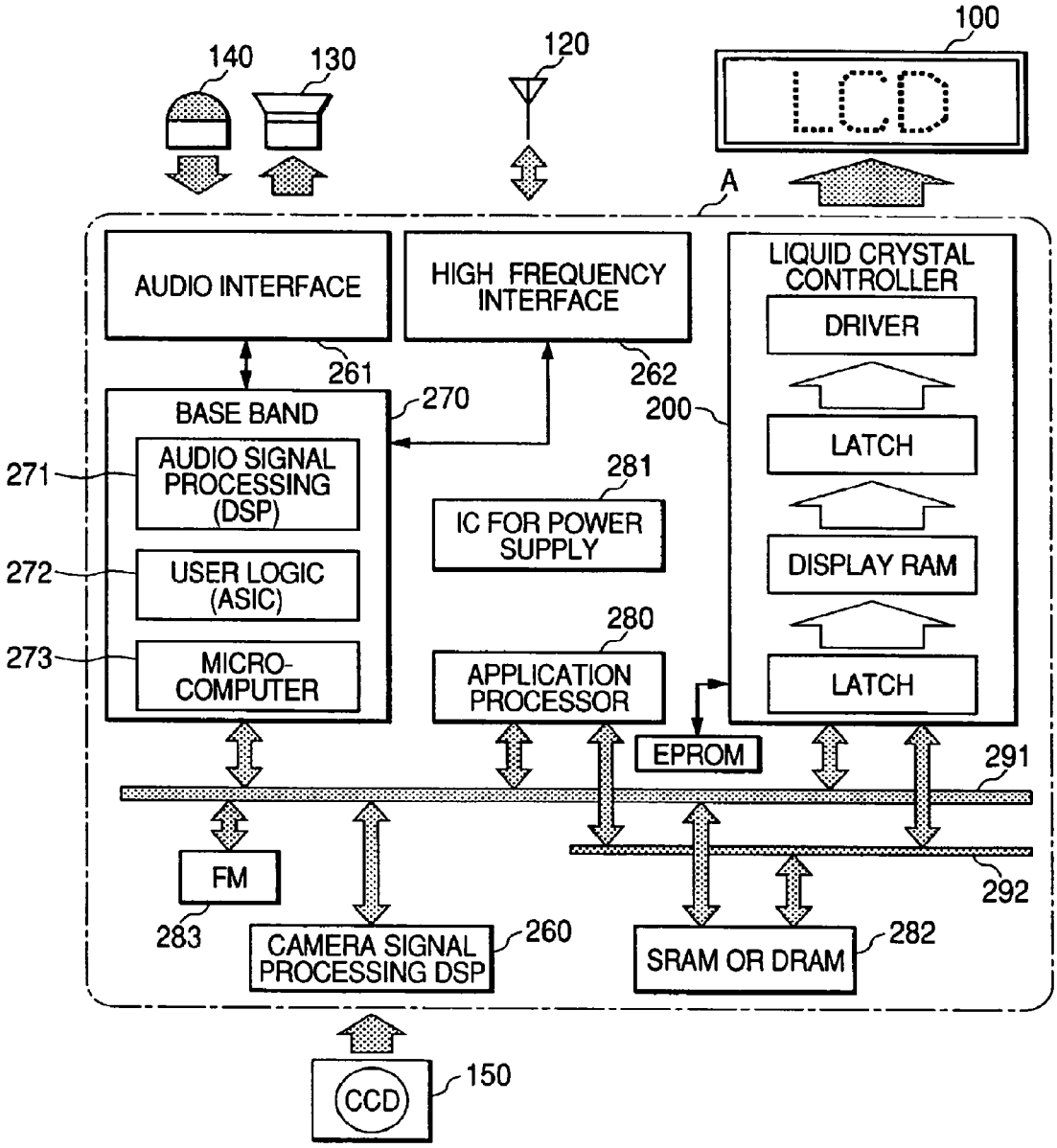
FIG. 8 is a block diagram showing an example of system configuration of a mobile telephone equipped with the liquid crystal controller driver according to the invention.

FIG. 8 is a block diagram showing the overall configuration of a mobile telephone equipped with the display control/drive device (liquid crystal controller driver) according to the invention.

This mobile telephone embodying the invention is equipped with the liquid crystal panel 100 as the display unit, an antenna 10 for transmission/reception use, a loudspeaker 130 for audio outputting, a microphone 140 for audio inputting and a solid image pickup element 150 consisting of a (charge coupled device (CCD), an MOS sensor or the like. It is also provided with an image signal processor circuit 260 consisting of a DSP or the like for processing image signals from the solid image pickup element 150, the liquid crystal controller driver 200 according to the invention, an audio interface 261 outputting and inputting signals to the loudspeaker 130 and the microphone 140, respectively, and a high frequency interface 262 for outputting and inputting to and from the antenna 120. It is further equipped with a base band unit 270 for signal processing pertaining to audio signals and transmit/receive signals, a moving picture processing circuit (application processor) 280 consisting of a microprocessor or the like having multimedia processing function, such as moving picture processing conforming to the MPEG system, a resolution adjusting function, a JAVA high speed processing function and so forth, a power supply IC 281 and a memory 282 for storing data. The application processor 280 has a function to process not only image signals from the solid image pickup element 150 but also moving picture data received from another mobile telephone via the high frequency interface 262.

The ICs and parts surrounded by the one-dot chain line are mounted over a single substrate, such as a printed circuit board. Although the liquid crystal controller driver 200 was previously often mounted on the same substrate, the liquid crystal controller driver 200 and the power supply IC 281 are mounted over the glass of the liquid crystal panel 100 in increasing cases since mobile terminals including mobile telephones are small and thin. The image signal processor circuit 260, the liquid crystal controller driver 200, the base band unit 270, the application processor 280 and the memory 282 are connected by a system bus 291, the liquid crystal controller driver 200, the application processor 280 and the memory 282 are further connected to a display data bus 292.

Incidentally, the base band unit 270 comprises an audio signal processing circuit, consisting of a DSP for instance, for processing audio signals, an ASIC272 providing a customized function (user logic), and a microprocessor or microcomputer 273 as a data processing device for generating base band signals, controlling displays and controlling the whole system.

A flash memory 283 permitting collective erasure in prescribed block units stores the control program and control data, including display control, for the whole mobile telephone system. The memory 282, used as a frame buffer to store image data resulting from various ways of image processing, is composed of a SRAM or an SDRAM. The EEPROM connected to the liquid crystal controller driver 200 stores specifications including the $\gamma$ characteristic and the frame frequency of the liquid crystal panel used.

Although the invention accomplished by the present inventor has been described so far in specific terms with reference to the preferred embodiment thereof, obviously the invention is not limited to this embodiment but can be modified in various ways without deviating from its true spirit and scope. For instance, though the foregoing embodiment involved, as an example of display mode permitting a reduction in the substantial frame frequency, the partial displaying mode, in which displaying is done only in part of the display screen of the liquid crystal panel, this is not the only choice, but if the frame frequency can be reduced in a system even if the whole display screen is used for displaying, the invention can be applied to such a case as well.

In the foregoing description of the embodiment, the case in which the timing of transferring data from the latch circuit 243 for holding pixel data to the source line drive circuit 244 is staggered by half of one line, the timing of outputting from the source line drive circuit 244 to the liquid crystal panel can as well be staggered by half of one line depending on the circuit form.

Further in the foregoing embodiment, the timing of transferring data to the right and left halves of source lines of the same color on each line is staggered, it is also conceivable to stagger the timing between data on odd-number source lines and data on odd-number source lines out of the same color on one line. Also in this embodiment, source lines of the same color are divided into two groups, between which the timing is staggered, division into three or more groups is also possible if the period limitation does not forbid.

In the foregoing embodiment, the frequency dividing circuit 215 for generating the control signal SCS of the clock selection switching circuit 214 by dividing the frequency of the line clock LCK0 is provided and used for switching on every prescribed plurality of lines the group in which the timing is delayed, the group in which the timing is delayed may as well be switched on every prescribed plurality of lines by providing a signal indicating the frame period (FLM or the like) to the frequency dividing circuit 215. Further in the foregoing embodiment, the timing of transferring image data is staggered by switching the clocks CK1 and CK2 for supplying output timings to the latch circuit 243, half as many delay circuits as the source lines can be provided on the output side of the latch circuit 243 to have image data having passed the delay circuits switched with the control signal SCS. In this case, the clocks CK1 and CK2 can be dispensed with.

Further in the foregoing embodiment, a register for setting the display mode in which the substantial frame frequency can be reduced and the output timing is staggered when setting into this register is done, but a circuit for monitoring the frame frequency may be provided in the liquid crystal controller driver instead of the mode register. Then it will be possible to automatically stagger the output timing when the substantial frame frequency can be deemed to have dropped. Also, the number of groups for which the output timing is to be staggered may as well be varied according to the frame period. Thus, the longer the frame period, the greater can be the number of groups for which the output timing is to be staggered.

Although the foregoing description mainly referred to the application of the invention by the present inventor to the liquid crystal controller driver for driving the LTPS color liquid crystal panel, which is the field of utilization constituting its background, the invention is not limited to this field, but can also be applied to liquid crystal controller drivers for driving non-LTPS liquid crystal panels and organic EL display panels. Also, the liquid crystal controller driver according to the invention can be applied not only to driving a liquid crystal display for mobile telephones but also to a liquid crystal controller driver for driving the liquid crystal monitor of a laptop personal computer or of a PDA.

What is claimed is:

1. A display controller and driver device for use with a display panel having a plurality of scanning lines and a plurality of signal lines arranged to cross the a plurality of scanning lines, the display controller and driver device comprising:

a plurality of external terminals;

a drive circuit which provides voltages to the external terminals to be applied to the plurality of signal lines of the display panel on a time division basis, and for each of red, green and blue colors in accordance with a predetermined timing signal; and a register to set display modes, said register configured to set a first value and a second value, wherein the first value enables two or more groups of the drive circuit to supply the voltages at a same timing, and the second value enables the two or more groups of the drive circuit to supply the voltages at mutually different timings in which the sequence of outputs of the different groups is periodically varied, wherein a latch circuit for holding image data to be displayed is disposed at a stage preceding the drive circuit, and wherein output timings of different ones of the two or more groups are staggered by transferring image data to be transferred from the latch circuit to the drive circuit, in synchronization with clock signals each of which differ in timing from one another.

2. The display controller and driver device according to claim 1, wherein the display controller and driver device is configured to display only on a part of a display screen of the display panel.

3. The display control/drive device according to claim 1, wherein the plurality of external terminals are divided into two groups, and wherein one of the two groups supplies the voltages to signal lines arranged on one side of a center line of the display panel, and the other of the two groups supplies voltages to signal lines arranged on the other side of the center line.

4. The display control/drive device according to claim 1, wherein one of the display modes to be set in the register is a mode in which displaying is to be done only on a part of a display screen of the color display panel, wherein, when a value designating this display mode is set in the register, the period of a signal indicating one horizontal period is shortened during scanning of areas other than the partial display area while the period of the signal indicating one horizontal period is lengthened during the scanning of the partial display area, and wherein the prescribed timing signals are generated according to the signal indicating one horizontal period.

5. A. display controller and driver device for use with a display panel having a plurality of scanning lines and a plurality of signal lines arranged to cross the a plurality of scanning lines, the display controller and driver device comprising:

a plurality of external terminals;

a drive circuit which provides voltages to the external terminals to be applied to the plurality of signal lines of the display panel on a time division basis, and for each of red, green and blue colors in accordance with a predetermined timing signal; and a register to set display modes, said register configured to set a first value and a second value, wherein the first value enables two or more groups of the drive circuit to supply the voltages at a same timing, and the second value enables the two or more groups of the drive circuit to supply the voltages at mutually timings in which the sequence of outputs of the different groups is periodically varied, wherein the sequence of outputs is varied for each of a plurality of horizontal periods according to a signal corresponding to one horizontal period of the display panel.

6. A. display controller and driver device for use with a display panel having a plurality of scanning lines and a plurality of signal lines arranged to cross the a plurality of scanning lines, the display controller and driver device comprising:

a plurality of external terminals;

a drive circuit which provides voltages to the external terminals to be applied to the plurality of signal lines of the display panel on a time division basis, and for each of red, green and blue colors in accordance with a predetermined timing signal; and a register to set display modes, said register configured to set a first value and a second value, wherein the first value enables two or more groups of the drive circuit to supply the voltages at a same timing, and the second value enables the two or more groups of the drive circuit to supply the voltages at mutually different timings in which the sequence Of outputs of the different groups is periodically varied, wherein the sequence of outputs is varied for each frame period or each of a plurality of frame periods according to a frame period signal indicating the display period of one screen of the display panel.

7. A display controller and driver device for use with a display panel having a plurality of scanning lines and a plurality of signal lines arranged to cross the a plurality of scanning lines, the display controller and driver device comprising:

a plurality of external terminals;

a drive circuit which provides voltages to the external terminals to be applied to the plurality of signal lines of the display panel on a time division basis, and for each of red, green and blue colors in accordance with a predetermined timing signal; and a register to set display modes, said register configured to set a first value and a second value, wherein the first value enables two or more groups of the drive circuit to supply the voltages at a same timing, and the second value enables the two or more groups of the drive circuit to supply the voltages at mutually different timings in which the sequence of outputs of the different groups is periodically varied, wherein the display panel is a liquid crystal panel, and the sequence of outputs periodically varies according to an alternating signal generated to provide the period for alternating current (AC) driving of pixels of the liquid crystal panel.

* * * * *